US005845656A

United States Patent [19]

Assmann

[11] Patent Number: 5,845,656

[45] Date of Patent: Dec. 8, 1998

[54] APPLIANCE FOR HAIR STYLING AND/OR HAIR DRYING

[75] Inventor: Jürgen Assmann, Dorsten-Rhade, Germany

[73] Assignee: WIK Elektro-Hausgerate Vertriebs GmbH & Co. Produktions KG, Essen, Germany

[21] Appl. No.: 862,696

[22] Filed: May 23, 1997

[30] Foreign Application Priority Data

| | | | |
|---|---|---|---|
| Jun. 20, 1996 | [DE] | Germany | 196 24 456.0 |
| Jul. 22, 1996 | [DE] | Germany | 196 29 414.2 |
| Nov. 2, 1996 | [DE] | Germany | 196 45 212.0 |

[51] Int. Cl.[6] ..... A45D 20/08

[52] U.S. Cl. ..... 132/271; 34/97

[58] Field of Search ..... 132/118, 119.1, 132/271, 272, 228; 34/96, 97, 98; D28/13, 14, 15, 18

[56] References Cited

U.S. PATENT DOCUMENTS

| | | | |
|---|---|---|---|
| D. 259,742 | 6/1981 | Iammatteo | D28/18 |
| D. 354,152 | 1/1995 | Mathews | D28/18 |
| 1,951,269 | 3/1934 | Boeckx et al. . | |
| 4,019,260 | 4/1977 | Levy et al. | 34/97 |
| 4,391,047 | 7/1983 | Janssens et al. | 34/97 |
| 4,525,623 | 6/1985 | Da Silva | 34/96 |
| 4,955,145 | 9/1990 | Scivoletto | 132/271 |
| 5,161,317 | 11/1992 | Mc Dougal | 34/97 |
| 5,235,759 | 8/1993 | Rizzuto, Jr. | 34/97 |
| 5,275,339 | 1/1994 | Andis et al. | 34/97 |
| 5,488,783 | 2/1996 | Parkinson et al. | 34/98 |

FOREIGN PATENT DOCUMENTS

| | | | |
|---|---|---|---|
| 25 29 809 | 1/1977 | Germany . | |
| 2728406 | 1/1979 | Germany | 34/96 |
| 40 39 759 | 6/1992 | Germany . | |
| 94 00 473.0 | 12/1994 | Germany . | |
| 295 03 297.9 | 6/1995 | Germany . | |
| 295 02 820 | 5/1996 | Germany . | |
| 88/01838 | 3/1988 | WIPO . | |

*Primary Examiner*—Todd E. Manahan
*Attorney, Agent, or Firm*—Sixbey, Friedman, Leedom & Ferguson; David S. Safran

[57] ABSTRACT

An appliance (1) for hair styling and/or hair drying and especially for enhancing the condition, body and/or volume of the hair of a user, for a personal-use airflow device, especially a hair dryer or hot air curling brush, has a base body (2), a carrier plate (3) which adjoins the front of the base body (2), and a plurality of finger-like hair gripping elements (5) located on a first region (4) of the carrier plate (3) and projecting from it. Using the appliance (1) according to the invention, an outstanding hair styling and hair drying effect can be achieved by the carrier plate (3) having a second region (6) which adjoins the lower side of the first region (4) which is without hair gripping elements (5), and by at least some of the hair gripping elements (5) and the second region (6) being matched to one another such that, when appliance (1) is being used, the second region (6) of carrier plate (3) lies at least partially on the head of the user, while the hair gripping elements (5) are made to engage the hair and at least in part to lie against the head of the user in an essentially tangential arrangement of the hair gripping elements (5) relative to the head of the user.

25 Claims, 7 Drawing Sheets a = Φ 3,8
b = Φ 4
c = Φ 4,2
d = Φ 4,3
e = Φ 4,4
f = Φ 4,5
g = Φ 4,6
h = Φ 4,8
i = Φ 4,9
j = Φ 5
k = Φ 5,1
l = Φ 5,3
m = Φ 5,5
n = Φ 6

APPLIANCE FOR HAIR STYLING AND/OR HAIR DRYING

BACKGROUND OF THE INVENTION

1. Field of the Invention

The invention relates to an appliance for hair styling and/or hair drying, and especially for enhancing the condition, body and/or volume of the hair of a user. In particular, to a personal-use airflow device, especially a hair dryer or hot air curling brush, with a base body, a carrier plate which adjoins the front of the base body, and a plurality of finger-like hair gripping elements, the latter being located on a first region of the carrier plate and projecting from it.

2. Description of Related Art

An appliance of the initially mentioned type is known from German Utility Model 295 03 297. In this known appliance, so that the hair of the user can be easily combed, styled and dried, the outer surface of the hair gripping elements pass roughly continuously into the top and bottom of the base body or the carrier plate. This is done so that the hair gripping elements, over their entire length, can lie tangentially and in part flat against the scalp of the user. The gripped hair and the scalp are quickly dried in so doing.

Although the known appliance yields rather good results for enhancing the condition, body and volume of the hair of a user, it is rather difficult for the user to ensure the tangential arrangement and flat contact of the hair gripping elements when styling and drying the hair, therefore, when passing the appliance through the hair. Very often it happens that the appliance is moved through the hair with the tips of the hair gripping elements lying on the scalp or with the tips projecting and with a recumbent shaft of the hair gripping elements. This can adversely affect the hair styling and drying effect.

SUMMARY OF THE INVENTION

The invention takes a new approach and avoids the aforementioned defects.

According to the invention, in the initially mentioned appliance for hair styling and/or hair drying, it is provided that the carrier plate, in addition to the region which has the first hair gripping elements, has a second region without hair gripping elements which adjoins the first region below it. At least some of the hair gripping elements of the first region and the second region of the carrier plate are matched to one another, such that when the appliance is being used, the second region of the carrier plate is at least partially on the head of the user, while the hair gripping elements are made to engage the hair and to partially lie against the scalp of the user in an essentially tangential arrangement of the hair gripping elements to the head of the user.

This provision of a second region which adjoins the upper first region and on which there are no hair gripping elements, therefore, yields a type of stop for interacting the with head of the user, so that the hair gripping elements are always located at least essentially in the tangential direction to the head of the user when the appliance is being used. Ultimately, the invention ensures a defined alignment of the hair gripping elements in an essentially tangential arrangement, yielding an outstanding hair styling and hair drying effect as a result.

To make the second region of the carrier plate lie flat against the head of the user, in one preferred embodiment of the invention, it is provided that the second region of the carrier plate is matched essentially to the shape of the user's head and is arched to the inside. The arch extends advantageously from one side region of the appliance to another side region, the radius of the arch preferably being between 10 and 40 cm and especially 25 cm. Therefore, ultimately, improved positioning or fixing of the appliance during handling results due to this shape of the second region which is arched to the inside to match the shape of the head of the user.

On the one hand, to make the appliance according to the invention small and manageable, and on the other, to ensure good positioning of the second region of the carrier plate against the user's head, it is furthermore provided that the second region of the carrier plate is angled relative to the first region, the angle between the longitudinal axis of the hair gripping elements located on the first region of the carrier plate and the second region being between 100° and 140°, preferably, about 115°.

The second region of the carrier plate, however, is used not only to ensure or achieve specific contact of the appliance with the head of the user during handling, but can, if there are a plurality of air exit openings, not only on the first, but also on the second region of the carrier plate, at least contribute to drying of the hair and scalp when the appliance is being used. This is, of course, the case especially because the second region of the carrier plate adjoins at least partially the head or the scalp of the user.

In one especially advantageous embodiment of the invention, the diameter of the air exit openings increases from the middle of the appliance, roughly from the transition area of the first region of the carrier plate to the second region to the outside. This means that the air passage openings to some extent have different sizes. Via the air passage openings of different sizes, on the one hand, the flow quantity, and on the other hand, the speed of the passing air, can be influenced. Since generally the transition area from the first region of the carrier plate to the second does not directly adjoin the user's head, therefore, there is a certain distance to the scalp. To achieve a good drying effect, it is necessary that at the transition locations the air emerges at a higher speed from the carrier plate, while there is an edge area of the second region of the carrier plate for resting on the user's head and here a large amount of air with a low flow speed is necessary.

To achieve a good support effect of the appliance over the second region of the carrier plate, the area of the second region should be greater than that of the first region. Here, last but not least, to achieve a pleasing design, the carrier plate should be made elliptical, for which the first region of the carrier plate should have a crescent shape.

To increase the hair styling and hair drying effect, preferably, there should be at least one air exit opening on each hair gripping element. In this way, the hair gripping elements can be used not only for hair styling, but also for hair drying. The hair styling and drying effect is especially pronounced when the hair gripping elements have several air exit openings distributed over the periphery in the area of their front end, and in the middle to rear area, likewise, have several air exit openings distributed over the periphery. The exit openings should preferably be made as slots.

To achieve a good hair styling and drying effect, it is generally enough if there are two rows of hair gripping elements on the first region of the carrier plate. It is a good idea if the hair gripping elements of each series are arranged in the manner of arc sections roughly to match the head shape of the user.

Preferably, the ends of the hair gripping elements of the two rows are each located on an imaginary convex line, it being possible to place the point of maximum arc roughly in the center of the width of the appliance. The convex arrangement of the ends of the hair gripping elements offers the advantage that the appliance can be more or less rolled on the scalp of the user while it is being used, by which different regions of the scalp and the hair can be dried more quickly without the appliance needing to be pushed on the scalp.

The hair styling and hair drying effect can be further increased by the hair gripping elements being arranged in adjacent rows to one another, the distance of the adjacent hair gripping elements of a row corresponding roughly to the diameter of one hair gripping element. Good air emergence from the hair gripping elements is ensured by the above described special distribution and arrangement of air exit openings over the periphery of the hair gripping elements and the offset of the hair gripping elements.

So that the hair gripping elements can effectively engage the hair, they have an essentially round cross section and they run to a point towards their front end. For adjacent hair gripping elements, this yields an insertion slot which is enlarged to the front and which becomes narrower towards the carrier plate or towards the first region of the carrier plate. When the appliance is being used, the hair is more or less forced against the hair gripping elements; this benefits the hair drying and hair styling effect.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENTS

Figure 1:
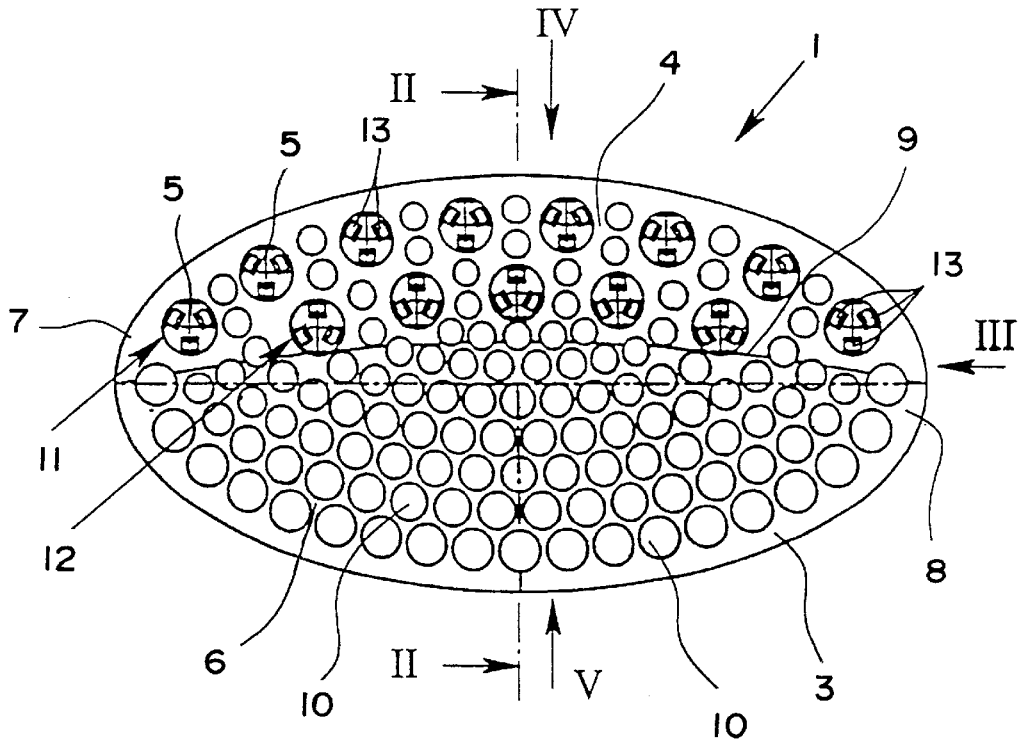
FIG. 1 is a front elevational view of an appliance according to the invention.

The figures show an appliance 1 for an airflow device for personal use, for example, hair drier 20 (FIG. 9) or a hot air curling brush (not shown). Appliance 1 is used for hair styling and hair drying. In particular, it is used to enhance the condition, body and volume of the user's hair.

Appliance 1 has base body 2 with a carrier plate 3 which adjoins the front side of base body 2. In this embodiment, base body 2 and carrier plate 3 are two separate components which are, however, permanently joined to one another. Of course, it is also possible to make base body 2 and carrier plate 3 of a one-piece construction. On a first region 4 of carrier plate 3 is a series of finger-like hair gripping elements 5. Hair gripping elements 5 project from the first area 4 of carrier plate 3 roughly at a right angle. The length of the hair gripping elements 5 is between 30 mm and 80 mm.

It is significant that carrier plate 3 has a second region 6 which is adjacent and below first region 4 and on which there are no hair gripping elements 5. Furthermore, the second region 6 of carrier plate 3 and at least some of the hair gripping elements 5 are matched to one another with respect to length, shape and construction, such that when appliance 1 is being used, the second region 6 of carrier plate 3 at least partially adjoins the head of the user, while hair gripping elements 5 are made to engage the hair of the user and at least partially abut the head of the user in an essentially tangential arrangement of hair gripping elements 5 to the user's head. The arrangement and execution of hair gripping elements 5 and second region 6 of carrier plate 3 are such that hair gripping elements 5 lie at least here and there on the scalp of the user. This state can be permanently ensured by the configuration of second region 6 of carrier plate 3 also during use, i.e., when appliance 1 is being pushed or moved over the head of the user.

Figures 7, 8:
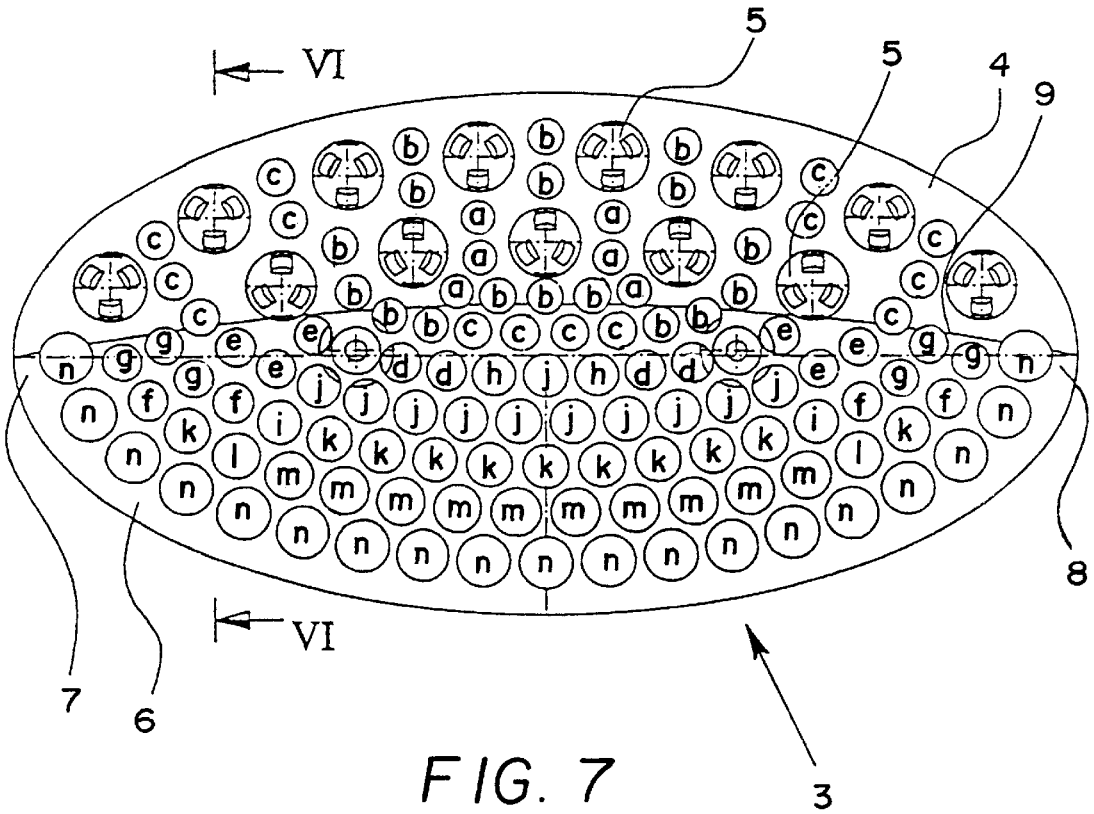
FIG. 7 shows a view of the carrier plate corresponding to that of FIG. 1.
FIG. 8 shows a tabulation of the diameter (in mm) of the air exit openings in the carrier plate shown in FIG. 7.

In the embodiment shown, second region 6 of carrier plate 3 is essentially matched to the head shape of the user. For this reason, it is inwardly curved from one side area 7 to the other side area 8 with an arc radius of roughly 25 cm, this curvature being apparent in FIGS. 4 & 5. Furthermore, the second region 6 of carrier plate 3 is angled relative to the first region 4. A transition 9 from the first region 4 of carrier plate 3 to the second region 6 is can be seen in FIGS. 1 & 7. The angling of the second region 6 of carrier plate 3 relative to the first region 4 is such that an angle $\alpha$ is formed between the longitudinal axis L of the hair gripping elements 5 located on the first region 4 of the carrier plate 3 and the second region 6 of carrier plate 3 is about 115°.

A plurality of air exit openings 10 can be provided on both the first area 4 of carrier plate 3 and also on second region 6; but, embodiments are also possible without these air exit openings. The diameters of the air exit openings 10 increase in directions proceeding outwardly from the center of appliance 1, i.e., from the center of the first region 4 of carrier plate 3, across the transition area 9 and second region 6. The arrangement and execution of air exit openings 10 with respect to their diameter are apparent from FIG. 7 in conjunction with the tabulation of the diameter of the individual air exit openings 10 in FIG. 8.

Carrier plate 3, itself, has an elliptical shape. Based on transition 9 from first region 4 of carrier plate 3 to second region 6, first region 4 is crescent-shaped and is smaller in area than second region 6. In the middle area of appliance 1, the width of second region 6 of carrier plate 3 is roughly twice that of first region 4. On the first region 4 of the carrier plate 3 there are first upper row 11 and second lower row 12 of hair gripping elements 5. The first upper row 11 has eight hair gripping elements 5, while in second lower row 12 there are five hair gripping elements 5. Hair gripping elements 5 of rows 11, 12 are each arranged in the form of a circular arc segment which is matched to the shape of the user's head and which has a radius of less than 30 cm.

Each of the Hair gripping elements 5 have a plurality of air exit openings 13. In the area of the front end 14, there are three air exit openings 13 which are distributed around the periphery of the individual hair gripping elements 5. Likewise, in the middle to rear area of the hair gripping elements 5 there are air exit openings 13 distributed around the periphery of gripping elements (see FIGS. 4, 6 & 10). Each of the individual air exit openings 13 are slot-shaped and extend in the direction of the longitudinal axis L of the hair gripping elements 5.

Figure 2:
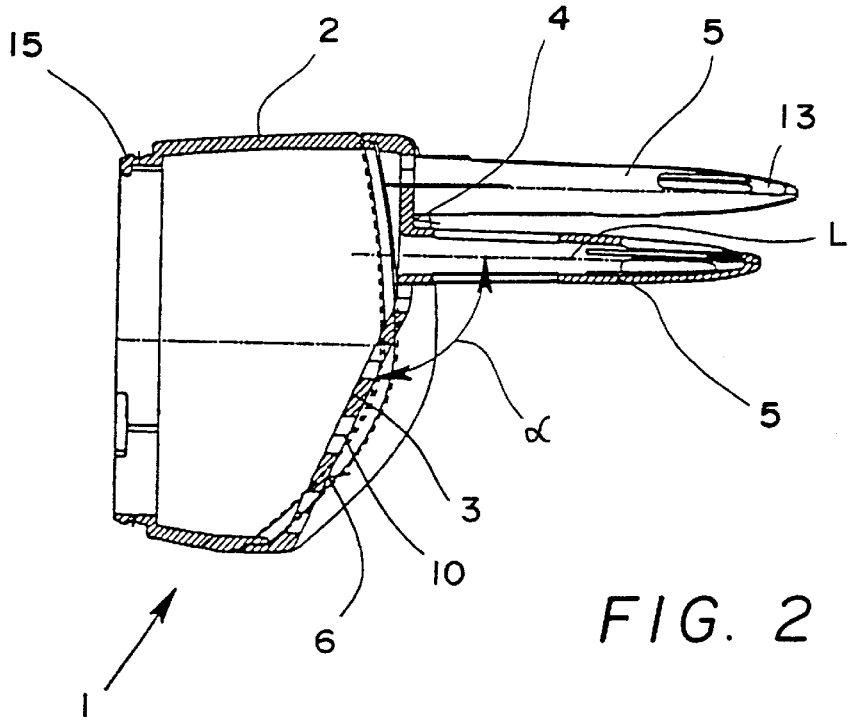
FIG. 2 a side cross-sectional view of the appliance shown in FIG. 1, taken along line II—II in FIG. 1.
Figure 3:
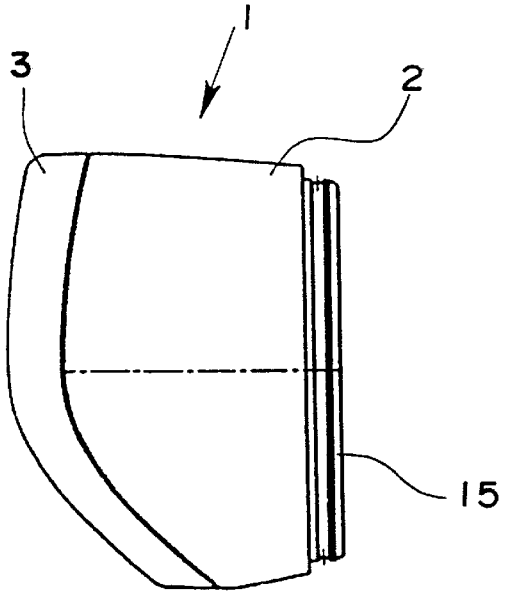
FIG. 3 is an elevational view of the FIG. 1 appliance viewed in the direction of arrow III in FIG. 1, but without the hair gripping elements.
Figure 4:
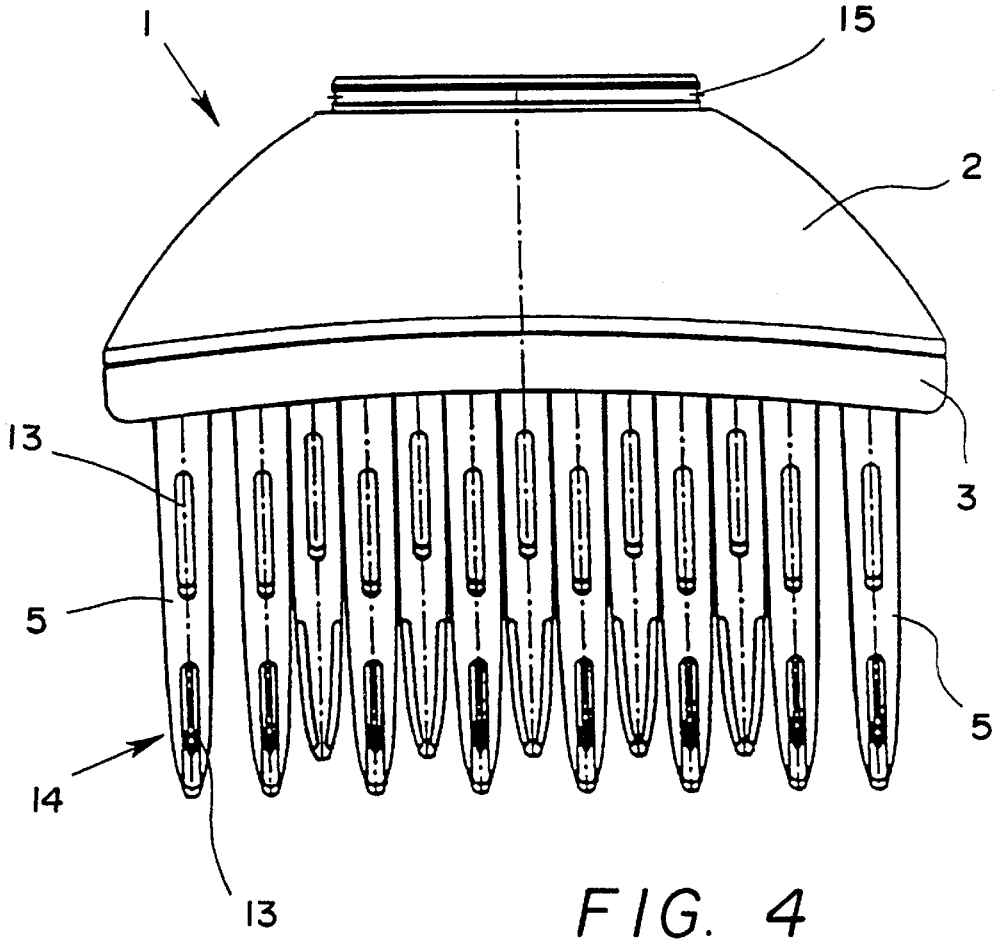
FIG. 4 is an elevational view of the FIG. 1 appliance viewed in the direction of arrow IV in FIG. 1.
Figure 5:
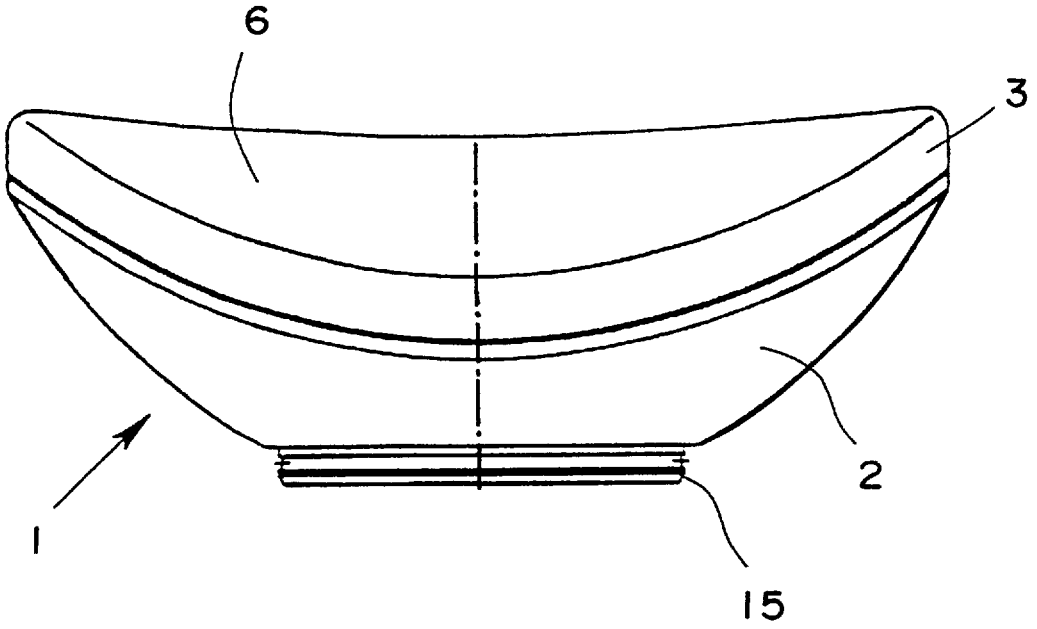
FIG. 5 is an elevational view of the FIG. 1 appliance viewed in the direction of arrow V in FIG. 1.
Figure 6:
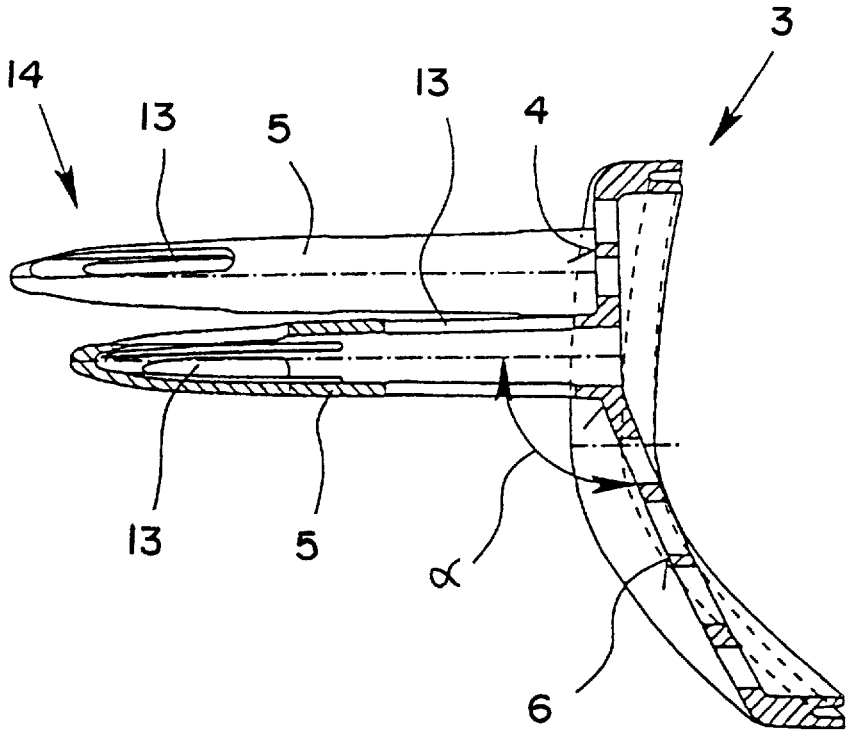
FIG. 6 shows a side cross-sectional view of a carrier plate of an appliance according to the invention taken along line VI—VI in FIG. 7.

In particular, FIGS. 1 and 7, on the one hand, and FIG. 4, on the other, show that the hair gripping elements 5 of first row 11 and second row 12 are arranged offset to one another. The distance of adjacent hair gripping elements 5 of rows 11, 12 corresponds roughly to the diameter of the lower area of one hair gripping element 5. Furthermore, FIGS. 2, 4 and 6 show that the front ends 14 of the hair gripping elements 5 of the top, first row 11 project beyond the front ends 14 of the hair gripping elements 5 of the lower, second row 12. Hair gripping elements 5 have an essentially round cross section and their front ends 14 taper to a point.

Appliance 1, itself, in the embodiment shown, is made as a part which can be handled separately and on the inner side has coupling area 15 for attachment to a device, e.g. to a hair drier, etc.

Figure 9:
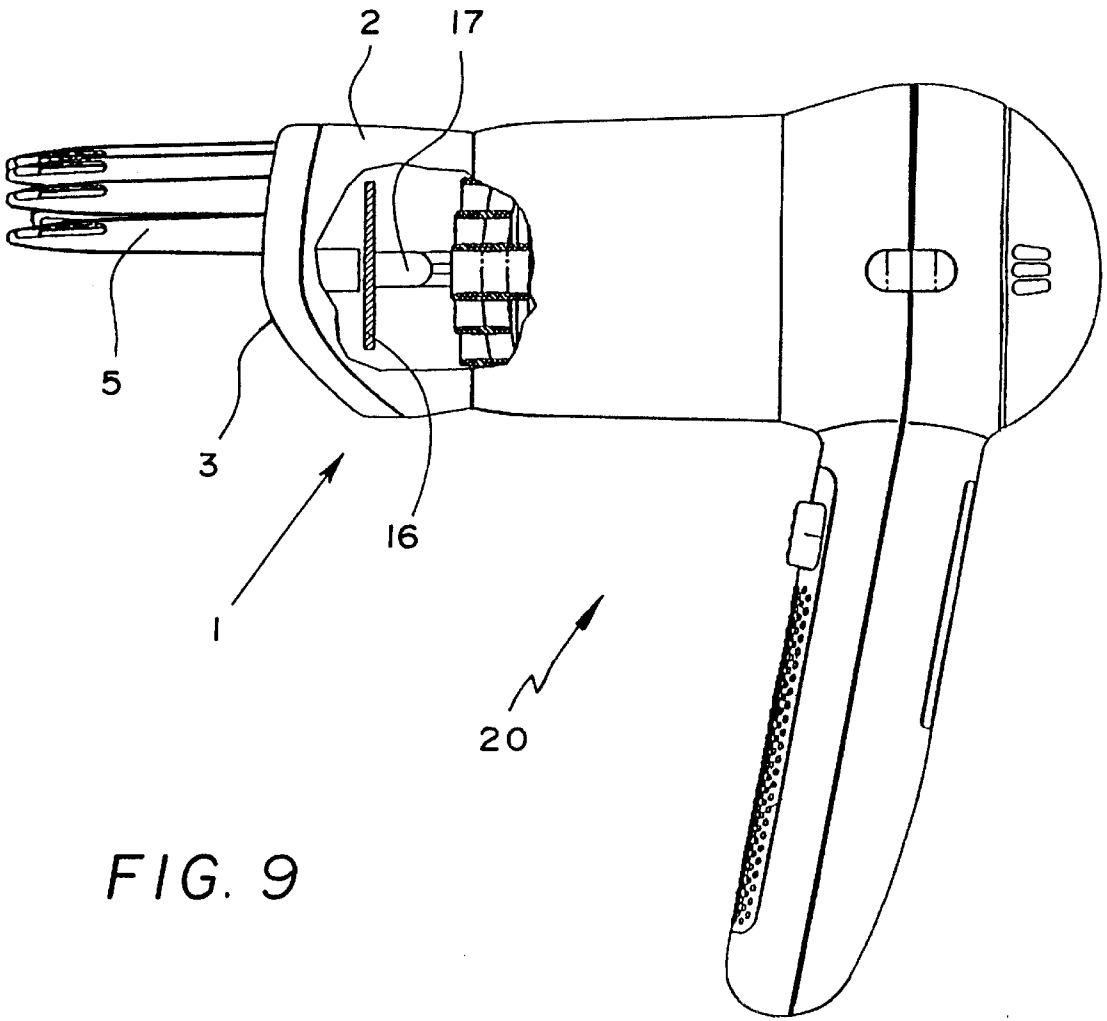
FIG. 9 shows a side view of an appliance of the invention in conjunction with a hair drier.

FIG. 9 shows a hair drier 20 which is an integral part of the appliance 1. In this embodiment, in appliance 1 and behind the carrier plate 3 there is air distribution plate 16. Air distribution plate 16 is located in front of carrier plate 3 in an outward air flow direction. In this embodiment, air distribution plate 16 is made as a baffle. This means that the outgoing air strikes air distribution plate 16, is deflected and then flows through the annular gap between the outer edge of air distribution plate 16 and the inside of base body 2 to air exit openings 10, 13 in carrier plate 3 and in hair gripping elements 5. It has been ascertained that an air distribution plate 16 made as a baffle yields especially good distribution and swirling of the air. In this embodiment, air distribution plate 16 is attached to a middle arm 17 which extends into the base body 2 from the body of the hair drier 20. In the separately handled version of the appliance 1, the air distribution plate 16 can be attached, for example, to at least two crosspieces on the inside of base body 2.

Figure 10:
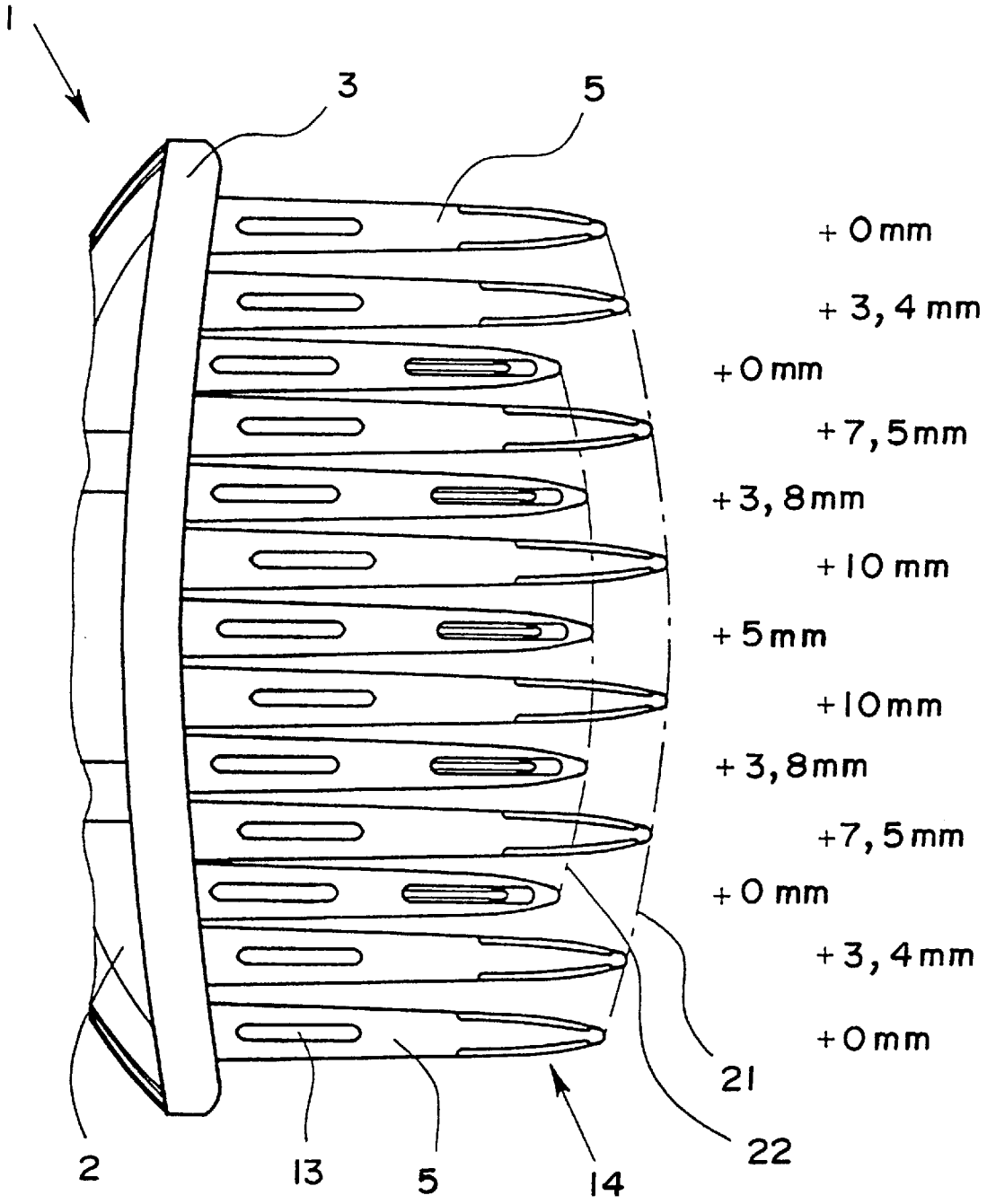
FIG. 10 shows a side view of another embodiment of an appliance according to the invention.

FIG. 10 shows another embodiment of the appliance 1 according to the invention. The appliance shown in FIG. 10 corresponds essentially to the one shown in FIG. 4. The sole difference is that the outer ends of the hair gripping elements 5 of both upper row 11 and also lower row 12 are each located on imaginary convex line 21, 22. The maximum curvature of the lines 21, 22 is thus in the center of the width of appliance 1. In particular, it is provided here that two inner hair gripping elements 5 of upper row 11 each project roughly 10 mm relative to the outermost hair gripping elements 5 of upper row 11, while two immediately following hair gripping elements 5 each project 7.5 mm and subsequent hair gripping elements 5 each project 3.4 mm relative to respective outer hair gripping elements 5. Conversely, in the lower row it is provided that middle hair gripping element 5 projects 5 mm relative to respective outermost hair gripping elements 5 of lower row 12, while two adjacent hair gripping elements 5 each project 3.8 mm relative to respective outermost hair gripping elements 5 of lower row 12. These dimensions are all indicated to the right of the gripping elements in FIG. 10.

Figure 11:
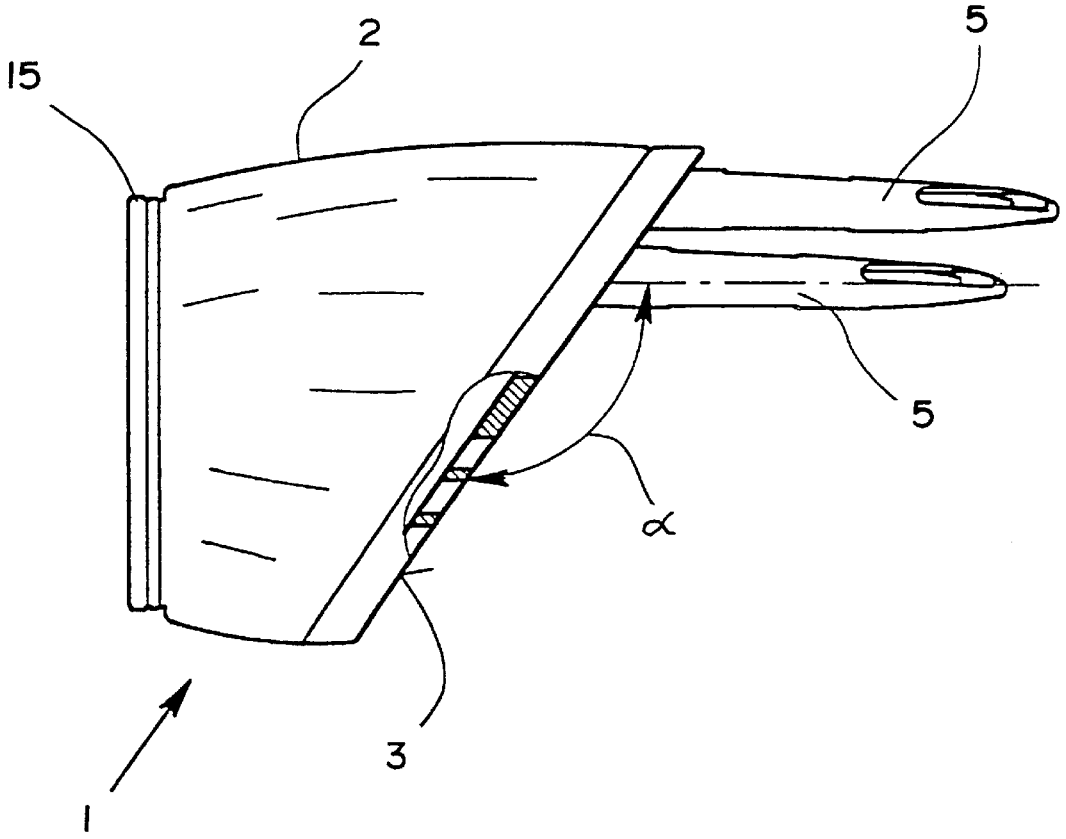
FIG. 11 shows a side view of still another embodiment of an appliance according to the invention.

In the embodiment of appliance 1 according to the invention which is shown in FIG. 11, the first region 4 of the carrier plate 3 and its second region 6 form a continuous surface. In this embodiment, therefore, the second region 6 of the carrier plate 3 is not angled relative to the first region 4 and no transition area is required.

Carrier plate 3, as a whole, or its first region 4 and/or its second region 6 can be made flat, concave or convex.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Appliance for a personal-use airflow hair device, comprising a base body, a carrier plate at a front side of the base body and a plurality of finger-shaped hair gripping elements located on a first region of the carrier plate and projecting from it; wherein the carrier plate has a second region which adjoins a lower side of the first region which is without hair gripping elements; wherein the second region of the carrier plate is at an angle relative to the first region of the carrier plate; wherein an angle $\alpha$ between a longitudinal axis of the hair gripping elements and the second region of the carrier plate is between about 100° and about 140°; and wherein at least some of the hair gripping elements and the second region of the carrier plate are matched to one another with respect to length, shape and construction in a manner causing, in use of the appliance with the second region of the carrier plate lying at least partially on the head of a user, the hair gripping elements to engage the hair and at least in part to lie against the head of the user in an essentially tangential arrangement of the hair gripping elements to the head of the user.

2. Appliance according to claim 1, wherein the second region of the carrier plate is matched essentially to the shape of the user's head by being provided with an inward curvature from one side region of the appliance to an opposite side region.

3. Appliance according to claim 2, wherein the curvature of second region of the carrier plate has a radius of curvature between 10 and 40 cm.

4. Appliance according to claim 2, wherein the radius of curvature is about 25 cm.

5. Appliance according to claim 1, wherein angle $\alpha$ is about 115°.

6. Appliance according to claim 1, wherein a plurality of air exit openings are provided in at least one of the first region of the carrier plate and the second region of the carrier plate.

7. Appliance according to claim 6, wherein air exit openings which are closer to a middle of the appliance have a smaller diameter than air exit openings which are disposed outwardly thereof relative to said middle.

8. Appliance according to claim 6, wherein the air exit openings are arranged, at least in part, in arcuate rows and in which diameters of the openings decrease from row to row starting from an outermost row.

9. Appliance according to claim 1, wherein the second region of the carrier plate is greater in area than the first region.

10. Appliance according to claims 1, wherein the carrier plate is essentially elliptical and the first region of the carrier plate is essentially crescent-shaped; and wherein the second region has a width in a middle area of the carrier plate is approximately twice that of the first region.

11. Appliance according to claims 1, wherein said hair gripping elements are arranged in two rows, a first, upper row of which has eight hair gripping elements and a second, lower row of which has five hair gripping elements.

12. Appliance according to claim 1, wherein outer ends of the hair gripping elements are located on an imaginary convex line having an apex which is approximately in a widthwise center of the appliance.

13. Appliance according to claim 12, wherein the hair gripping elements are arranged in rows, each row being in the form of a circular arc segment.

14. Appliance according to claim 13, wherein the hair gripping elements are arranged offset relative to one another in two adjacent rows.

15. Appliance according to claim 14, wherein adjacent hair gripping elements of the same row are spaced from each other by a distance which is approximately the same as the diameter of a lower area of a single hair gripping element.

16. Appliance according to claim 1, wherein each of the hair gripping elements has a plurality of air exit openings.

17. Appliance according to claim 16, wherein at least some of said air exit openings are located in a front end area of each of the hair gripping elements.

18. Appliance according to claim 17, wherein at least one additional air exit opening is provided in a middle to rear area of each hair gripping element.

19. Appliance according to claim 17, wherein the hair gripping elements are arranged in rows; and wherein front ends of hair gripping elements of a top row project beyond front ends of hair gripping elements of a lower row.

20. Appliance according to claims 19, wherein the hair gripping elements have an essentially round cross section and taper to a point at a front end thereof.

21. Appliance according to claim 16, wherein at least three air exit openings are distributed peripherally around each of the hair gripping elements.

22. Appliance according to claim 16, wherein the air exit openings in the hair gripping elements are slot-shaped and are aligned approximately with a longitudinal axis of the hair gripping elements.

23. Appliance according to claim 1, wherein on a rear side of the base body there is a coupling area for attachment of the appliance to at least one of a hair drying device and a hot air hair curling device.

24. Appliance according to claim 1, wherein an air distribution plate is disposed behind the carrier plate.

25. Appliance according to claim 24, wherein the air distribution plate is a baffle plate.

* * * * *